US005904297A

United States Patent [19]

Kendrick, Jr. et al.

[11] Patent Number: 5,904,297

[45] Date of Patent: May 18, 1999

[54] TWO-HANDED SHUT-OFF VALVE

[75] Inventors: Dewey L Kendrick, Jr., Sara Land, Ala.; Matthew O. Herhold, Fenton, Mich.

[73] Assignee: NLB Corporation, Wixom, Mich.

[21] Appl. No.: 08/996,688

[22] Filed: Dec. 23, 1997

Related U.S. Application Data

[60] Provisional application No. 60/056,901, Aug. 22, 1997.

[51] Int. Cl.[6] ..... B05B 9/00; B05B 7/02

[52] U.S. Cl. ..... 239/124; 239/526

[58] Field of Search ..... 239/124, 525, 239/526, 530, 569

[56] References Cited

U.S. PATENT DOCUMENTS

| | | | |
|---|---|---|---|
| 3,885,739 | 5/1975 | Tuttle | 239/124 |
| 4,784,330 | 11/1988 | Hammelmann | 239/526 |
| 5,092,362 | 3/1992 | Yie | 137/596.1 |
| 5,165,451 | 11/1992 | Goldsmith | 137/882 |
| 5,349,982 | 9/1994 | Goldsmith | 137/454.5 |
| 5,570,722 | 11/1996 | Goldsmith | 137/882 |
| 5,588,593 | 12/1996 | Boisture | 239/67 |
| 5,636,789 | 6/1997 | Shook | 239/124 |

*Primary Examiner*—Andres Kashnikow
*Assistant Examiner*—Jorge S. Bocanegra
*Attorney, Agent, or Firm*—Howard & Howard

[57] ABSTRACT

A pressurized fluid discharge gun is used to spray high pressure fluid against various types of surfaces for cleaning purposes. To operate the gun two handles, each with a separate trigger, must be firmly held by the operator. When both triggers are compressed firmly towards the handle, highly pressurized fluid exits the gun. If either one of the triggers is released then the fluid is dumped to a low pressure discharge, i.e. high pressure fluid is not permitted to exit the gun. The gun has a high pressure pipe and a low pressure pipe connected to a main body. A valve assembly, located in the main body, controls whether the fluid from the inlet goes to the high pressure pipe or the low pressure pipe. The valve assembly has a high pressure path and a low pressure path interconnected by two passages. Two pin valves, each controlled by one of the triggers, block the two passages when the triggers are compressed resulting in high pressure fluid flow. When either trigger is released, the pin valve moves causing its respective passage to open resulting in low pressure fluid flow.

16 Claims, 2 Drawing Sheets

TWO-HANDED SHUT-OFF VALVE

This application claims benefit of U.S. Provisional application No. 60/056,901, filed Aug. 22, 1997.

BACKGROUND OF THE INVENTION

This invention relates to a unique valve assembly for controlling fluid flow between high and low pressures in a pressurized fluid discharge device.

Pressurized fluid spray guns are used to spray high pressure fluids against various types of surfaces which need to be cleaned. These spray guns are typically hand held. When spraying highly pressurized fluids from a spray gun, it is importance to have two hands supporting the gun so that the high pressure fluid spray can be effectively controlled. If an operator were to release one hand from the gun, it is possible that the operator would not be able to adequately control the spray gun. Typically, these spray guns have two handle grips, one for each hand, which are used to hold and control the gun. During use, it is possible that the gun leaves one or both of the operators hands. It is then difficult to control the gun.

Prior art spray guns have utilized a single trigger, associated with one of the handles, to control the operation of the gun. This trigger operates a valve which controls whether the fluid will be discharged from the spray gun at a high or low pressure. If the trigger is compressed against the handle then the gun is allowed to eject high pressure fluid. If the trigger is not compressed then the gun dumps the fluid to a low pressure dump. This ensures that the spray gun is properly held and controlled during high pressure fluid discharges. However, as previously emphasized, it is important that two hands be used to hold the gun while it is spraying high pressure fluids. Thus, with prior art devices, if the hand that is holding the handle without the trigger is released, high pressure fluid will continue to be discharged and the operator may not be able to effectively control the spray gun.

It would be desirable to have a spray gun which requires dual hand control before the spray gun can discharge high pressure fluid. Thus, there is a need for a spray gun utilizing two trigger controls, one for each hand, which must be simultaneously compressed before high pressure fluid can be discharged from the spray gun. It would also be desirable to have both triggers control a single valve assembly with independently controlled valve members such that any increase in the size or complexity of parts for the gun is minimized.

SUMMARY OF THE INVENTION

A unique valve assembly is used in a pressurized fluid discharge gun which receives fluid through an inlet and delivers highly pressurized fluid against various types of surfaces for cleaning. To operate the gun, two handles, each with a separate trigger, must be firmly held by the operator. When both triggers are compressed firmly towards their respective handles, pressurized fluid exits the gun. If either one of the triggers is released then the fluid is dumped to a low pressure discharge, i.e. high pressure fluid is not permitted to exit the gun. The gun has a high pressure pipe and a low pressure pipe connected to a main body. The valve assembly, located in the main body, controls whether the fluid from the inlet goes to the high pressure pipe or the low pressure pipe. The valve assembly has a high pressure path and a low pressure path interconnected by two passages. Two pin valves, each controlled by a respective one of the triggers, block the two passages to the low pressure passageway when the triggers are compressed, resulting in high pressure fluid flow. When either trigger is released, the pin valve moves causing its respective passage to open and directs the fluid to the low pressure dump.

In the preferred embodiment, the valve assembly for the pressurized fluid discharge device includes a valve body which has a high pressure passageway and a low pressure passageway. Fluid enters the device through an inlet which delivers the fluid to the passageways. The device also includes a high pressure outlet for discharging the fluid at a high pressure from the high pressure passageway and a low pressure outlet for discharging the fluid at a pressure lower than the high pressure from the low pressure passageway. Spaced first and second passages interconnect the high and low pressure passageways. The valve assembly includes a first and second valve seat with a first and second valve, The valves block the respective passages when seated on the valve seats. An actuator seats each valve against its valve seat. Simultaneous seating of the valves against the valve seats by the actuators causes the fluid to flow from the inlet, through the high pressure passageway, and out the high pressure outlet. Unseating either of the valves from their respective valve seat by releasing one of the actuators causes the fluid to flow from the inlet, through one of the passages to the low pressure passageway, and out the low pressure outlet. Thus, if the operator has even one hand leave the gun, the fluid dumps.

The subject invention offers advantages over the prior art because it provides a pressurized fluid discharge gun which requires two hand control for high pressure fluid flow to occur. Thus, if the operator releases either hand from the gun the fluid is discharged via a low pressure outlet. This high pressure shut off feature is efficiently and effectively controlled by the subject valve assembly which utilizes a single valve chamber with independently controlled valve members to regulate high and low pressures.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF A PREFERRED EMBODIMENT

Figure 1:
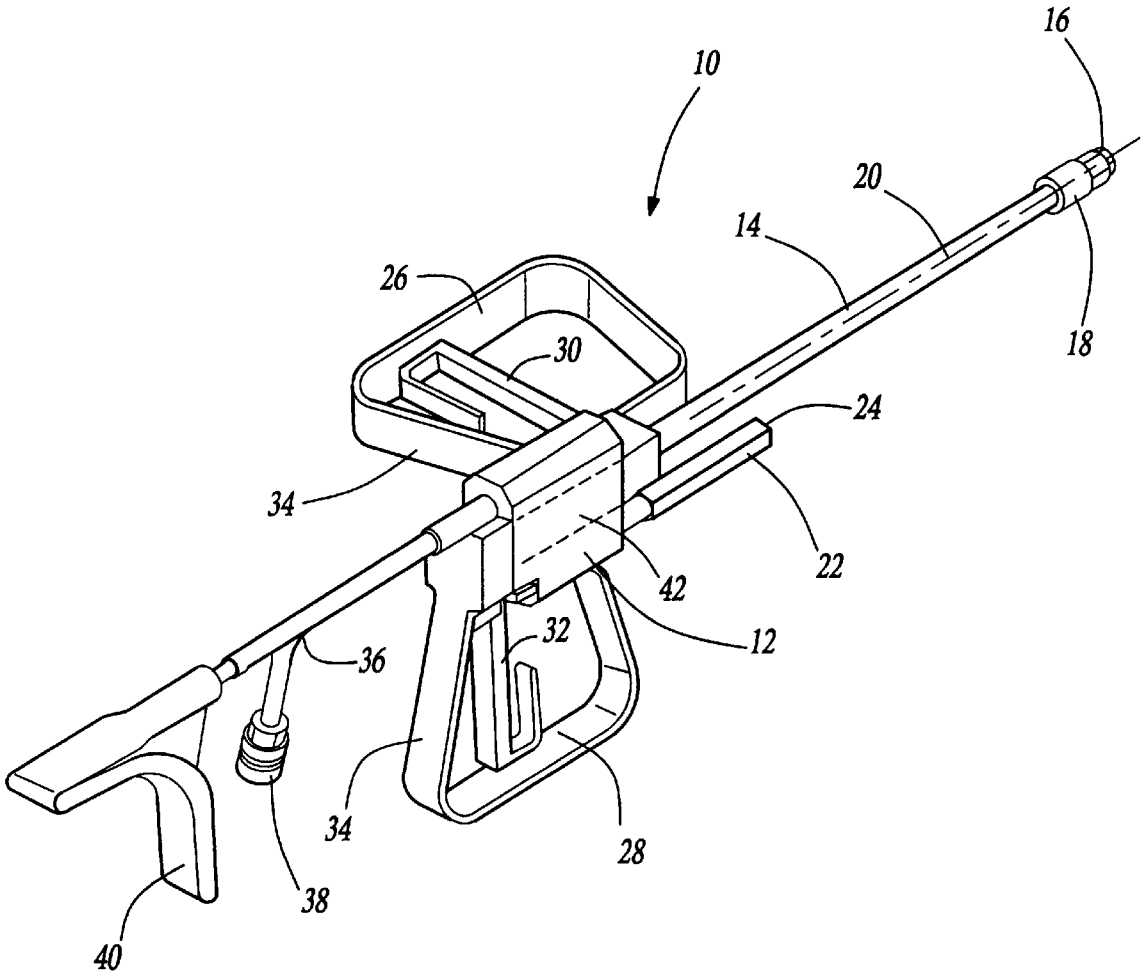
FIG. 1 is a perspective view of a high pressure spray gun utilizing the inventive valve assembly.

A high pressure spray gun shown generally at 10 in FIG. 1 includes a main body 12 and a high pressure conduit or pipe 14 with a high pressure nozzle 16. A nozzle adaptor 18 mounts the high pressure outlet 16 and is supported by the high pressure conduit 14. Adaptor 18 allows different nozzles to be attached to control the spray discharging from the spray gun 10. The high pressure pipe 14 defines a central axis 20 and is supported by the main body 12. The spray gun 10 also includes a low pressure conduit or pipe 22 supported by the main body 12 which has a low pressure outlet 24. In the preferred embodiment, the low pressure pipe 22 is spaced apart from the high pressure pipe 14 and is substantially parallel to the central axis 20, however, other configurations are possible.

A first grip 26 is supported by the main body 12 and extends out radially from the central axis 20. The main body 12 also supports a second grip 28 which extends out radially from the central axis 20. In the preferred embodiment, the first grip 26 is located at a position about ninety degrees about the central axis 20 from the second grip 28. In this configuration the first grip 26 is held by one hand to the side of the spray gun 10 while the other hand holds the second grip 32 underneath the spray gun 10. The location of the two grips 26, 28 with respect to each other ensures that the spray gun 10 is properly held and supported by an operator and ensures that the gun 10 will remain stable while high pressure fluid is being discharged.

The first 26 and second grips 28 have first 30 and second 32 trigger actuators, respectively. Actuators 30, 32 are moved with respect to their grips 26, 28 by the operator pulling them to a high pressure discharge position. When released, the actuators 30, 32 are in a low pressure position. Thus, when the spray gun 10 is not being held for use, has been temporarily set aside, or one hand simply falls away from its grip, high pressure fluid cannot be discharged. To reach the high pressure position, the operator has to hold the spray gun 10 with two hands and both actuators 30, 32 must be pulled by the operator towards a back portion 34 of the grips 26, 28. When both actuators 30, 32 are simultaneously in this position, high pressure fluid may be discharged from the high pressure nozzle 16.

An inlet 36 is located rearwardly of the main body 12 for delivering a fluid to the high 14 or low 22 pressure pipes. Inlet 36 has a connector fitting 38 for attachment to a hose or other fluid supply device.

A padded shoulder support 40 is located at an end opposite from the nozzle 16. The shoulder support 40 is generally formed in the shape of a "C" and extends downwardly from the central axis 20.

Figure 2A:
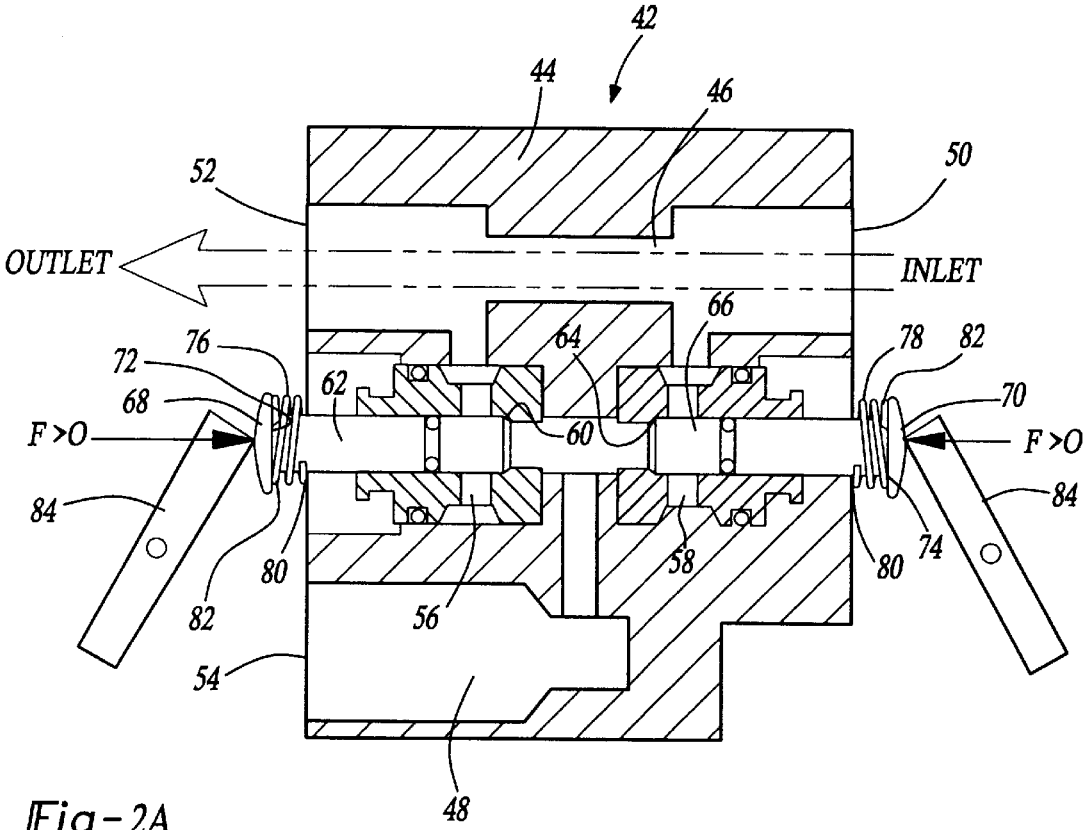
FIG. 2A is a cross sectional view of the inventive valve assembly in a high pressure fluid flow configuration.

A valve assembly 42 housed in the main body 12 controls whether or not the fluid is discharged at a high or low pressure. As shown in FIG. 2A, valve assembly 42 has a main valve body 44 defining a high pressure passageway 46 and a low pressure or dump passageway 48. Valve body 44 includes inlet 50 that may deliver fluid to either the high 46 or low 48 pressure passageway. Located on an opposite side of the valve body 44 from the valve inlet 50 is a high pressure valve outlet 52 for discharging the fluid at a high pressure after it passes through the high pressure passageway 46. Spaced apart from the high pressure valve outlet 52 and also located on the opposite side of the main valve body 44 from the valve inlet 50, is a low pressure or dump valve outlet 54 for discharging from low pressure passageway 48. Some means for reducing the fluid pressure to a low pressure is disposed downstream of passageway 48.

First 56 and second 58 passages interconnect the high 46 and low 48 pressure passageways. The first 56 and second 58 passages are substantially perpendicular to the high 46 and low 48 pressure passageways. The second 58 passage is spaced apart from and is preferably parallel to the first passage 56.

Valve body 44 defines a first valve seat 60 and includes a first valve 62 moveable with respect to the first valve seat 60. When the first valve 62 is seated on the first valve seat 60, the first passage 56 is blocked, i.e., no fluid can flow from the inlet 50 to the low pressure outlet 54 via the first passage 56. The valve body 44 also defines a second valve seat 64 and includes a second valve 66 moveable with respect to the second valve seat 64. When the second valve 66 is seated on the second valve seat 64, the second passage 58 is blocked, i.e., no fluid can glow from the inlet 50 to the low pressure outlet 54 via the second passage 58. In the preferred embodiment, the first 62 and second 66 valves are cylindrical pins which are moveable in fore and aft directions with respect to the valve body 44. Also, in the preferred embodiment the first 62 and second 66 valves are disposed on opposites sides of said valve body 44 from each other, however, other configurations are possible.

The first actuator 30 controls the position of the first valve 62 with respect to the first valve seat 60 and the second actuator 32 controls the position of the second valve 66 with respect to the second valve seat 64. When both actuators 30 and 32 are in the high pressure position, i.e., compressed towards the rear portion 34 of the grips 26, 28 , the valves 62, 66 are seated and the first 56 and second 58 passages are blocked. Thus, fluid enters the valve assembly 42 through the valve inlet 50, flows through the high pressure passageway 46, and exits via the high pressure valve outlet 52 as shown in FIG. 2A. This allows the spray gun 10 to discharge fluid at high pressures via its high pressure outlet 16.

Figure 2B:
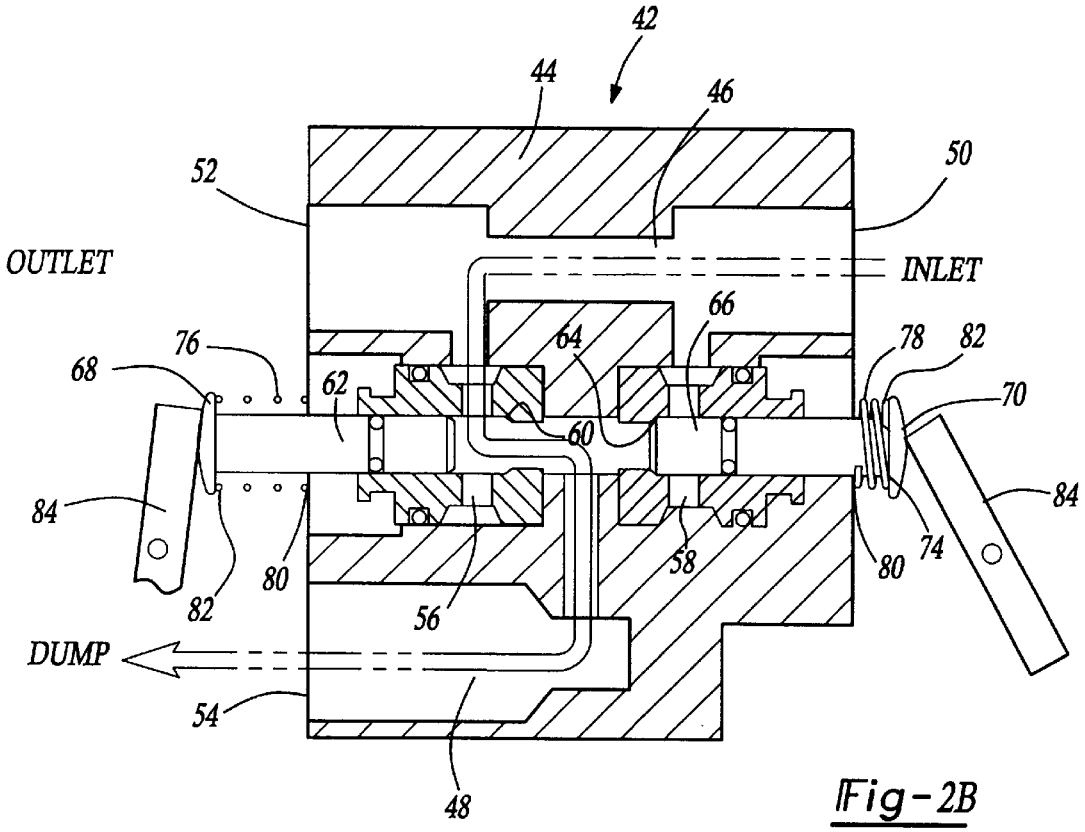
FIG. 2B is a cross sectional view of the inventive valve assembly in a low pressure fluid flow configuration.

When the first actuator 30 is in the low pressure position, the first valve 62 is unseated from the first valve seat 60 and the first passage 56 is open as shown in FIG. 2B. Fluid can then flow from the valve inlet 50, through the first passage 56, through the low pressure passageway 48, and out the low pressure valve outlet 54. The second actuator 32 is illustrated in the high pressure seated position. However, if its actuator is released the second valve 66 would be unseated from the second valve seat 64 and the second passage 58 would be open. Fluid can flow from the valve inlet 50, through the second passage 58, through the low pressure passageway 48, and out the low pressure valve outlet 54. Thus, if either valve 62 or 66 is unseated from its respective valve seat 62 or 64 or both valves 62 and 66 are unseated, i.e., if either or both actuators 30, 32 are in the low pressure position, then fluid will flow through the interconnecting passages 56, 58 to the low pressure passageway 48.

As shown in FIGS. 2A and 2B, a first valve head 68 is supported on the first valve 62 and a second valve head 70 supported on the second valve 66. A first flange 72 surrounds the first valve head 68 and a second flange 74 surrounds the second valve head 70. The first 72 and second 74 flanges are of greater diameter than the valve heads 68, 70. The first 68 and second 70 valve heads are supported by first 76 and second 78 springs, respectively, having a predetermined spring force. The first 76 and second 78 springs are supported on the main valve body 44 at one end 80 and are supported by the flanges 72, 74 of the valve heads 68, 70 at their opposite end 82 such that the first 76 and second 78 springs are compressible between the flanges 72, 74 and the valve body 44.

Springs 76, 78 bias the first 62 and second 66 valves to the unseated position. Actuators 30 and 32, when pulled, each move a lever 84 against heads 68, 70 to overcome the spring force and hold the valves at the seated positions. In order for the spray gun 10 to be able to discharge high pressure fluid, the first 30 and second 32 actuators must exert a force on the lever 84 greater than the predetermined spring force on the valve heads 68, 70. This will seat the valves 62, 66 against the valve seats 60, 64 and block the first 56 and second 58 passages, prohibiting fluid from discharging via the low pressure passageway 48.

A preferred embodiment of this invention has been disclosed, however, a worker of ordinary skill in the art would recognize that certain modifications come within the scope of this invention. For that reason, the following claims should be studied to determine the true scope and content of this invention.

We claim:

1. A high pressure fluid spray gun comprising:

a discharge nozzle;

a source of high pressure fluid;

a low pressure dump;

a valve body for communicating said source to either said dump or said nozzle;

a pair of hand held triggers; and said valve body being configured such that if an operator pulls on both said triggers said source communicates with said nozzle, and if an operator releases either of said triggers said source communicates with said dump.

2. A valve assembly for a pressurized fluid discharge device comprising:

a valve body having a high pressure passageway and a low pressure passageway;

an inlet for delivering a fluid to said passageways;

a high pressure outlet for discharging fluid at a high pressure from said high pressure passageway;

a low pressure outlet for discharging fluid at a pressure lower than said high pressure from said low pressure passageway;

a first passage interconnecting said high and low pressure passageways;

a second passage interconnecting said high and low pressure passageways, said second passage spaced apart from said first passage;

a first valve seat and a first valve moveable with respect to said first valve seat for blocking said first passage when seated on said first valve seat; and a second valve seat and a second valve moveable with respect to said second valve seat for blocking said second passage when seated on said second valve seat;

a first hand held actuator for seating said first valve against said first valve seat; and a second hand held actuator for seating said second valve against said second valve seat whereby simultaneous seating of said valves against said valve seats by said actuators causes said fluid to flow from said inlet, through said high pressure passageway, and out said high pressure outlet, and unseating either of said valves from said valve seats by releasing at least one of said actuators causes said fluid to flow from said inlet, through at least one of said passages to said low pressure passageway, and out said low pressure outlet.

3. A valve assembly as set forth in claim 2 including a first spring supported by said first valve and a second spring supported by said second valve, said first and second springs having a predetermined spring force for biasing said valves to said unseated position.

4. A valve assembly as set forth in claim 3 wherein said first and second valves are cylindrical pins having valve heads of larger diameter than said valves for supporting said first and second springs.

5. A valve assembly as set forth in claim 4 wherein said first and second springs are supported on said valve body at one end and abut said valve heads at an opposite end, respectively, such that said first and second springs are compressible between said valve heads and said valve body.

6. A valve assembly as set forth in claim 4 including a first valve head supported on said first valve and a second valve head supported on said second valve wherein said first and second actuators exert a force greater than a spring force on said valve heads for seating said valves against said valve seats.

7. A valve assembly as set forth in claim 1 wherein said first and second valves are disposed on opposites sides of said valve.

8. A valve assembly as set forth in claim 1, wherein said first and second actuators each include handles spaced from each other by 90° relative to a control axis of said gun.

9. A pressurized fluid discharge device comprising:

a main body;

a high pressure conduit, supported by said main body and defining a central axis, said high pressure conduit having a high pressure outlet;

a valve assembly housed in said main body and having a high pressure passageway, a low pressure passageway, a first passage interconnecting said high and low pressure passageways, a second passage interconnecting said high and low pressure passageways, a first valve moveable with respect to said main body and having a first valve seat, and a second valve moveable with respect to said main body and having a second valve seat, said first valve for blocking said first passage when seated on said first valve seat and said second valve for blocking said second passage when seated on said second valve seat;

an inlet for delivering a fluid to said valve assembly;

a first grip supported by said main body and extending out radially from said central axis, said first grip having a first actuator;

a second grip supported by said main body and extending out radially from said central axis, said second grip spaced apart from said first grip and having a second actuator wherein said first and second actuators are moveable between a high pressure position and a low pressure position; and a low pressure conduit supported by said main body and having a low pressure outlet wherein said fluid flows from said inlet to said high pressure outlet when said first and second actuators are simultaneously positioned in said high pressure position causing said first and second passages to be blocked by said first and second valves, respectively, and said fluid flows from said inlet to said low pressure outlet when said at least one actuator is positioned in said low pressure position causing at least one passage to open between said high and low pressure passageways.

10. A pressurized fluid discharge device as set forth in claim 9 wherein said first grip is located at a position ninety degrees or less about said central axis from said second grip.

11. A pressurized fluid discharge device as set forth in claim 10 wherein said first and second grips are handles having first and second triggers, respectively, said first and second triggers for controlling said first and second actuators between said high and low pressure positions.

12. A pressurized fluid discharge device as set forth in claim 9 wherein said first and second valves are supported by first and second springs having a predetermined spring force wherein said first and second actuators exert a force greater than said spring force against said valve heads for seating said valves against said valve seats resulting in fluid flow from said inlet to said high pressure outlet.

13. A pressurized fluid discharge device as set forth in claim 12 including a first flange surrounding said first valve and a second flange surrounding said second valve, said first and second flanges of greater diameter than said valves, wherein said valves are unseated when said spring force is greater than said force of said actuators against said valve heads causing said first and second springs to react against said first and second flanges, respectively, causing said first and second passages to open and resulting in fluid flow from said inlet to said low pressure outlet.

14. A pressurized fluid discharge device as set forth in claim 13 wherein said first and second springs are supported on said valve body at one end and abut said valve heads at an opposite end such that said first and second springs are compressible between said valve heads and said valve body.

15. A pressurized fluid discharge device as set forth in claim 9 wherein said low pressure conduit is parallel to said central axis.

16. A pressurized fluid discharge device as set forth in claim 9 wherein a padded shoulder portion is provided on an opposed side of said valve from a high pressure outlet.

* * * * *